US007476264B2

(12) United States Patent
Krull

(10) Patent No.: US 7,476,264 B2
(45) Date of Patent: Jan. 13, 2009

(54) COLD FLOW IMPROVERS FOR FUEL OILS OF VEGETABLE OR ANIMAL ORIGIN

(75) Inventor: Matthias Krull, Harxheim (DE)

(73) Assignee: Lariant Produkte (Deutshland) GmbH, Sulzbach (DE)

( * ) Notice: Subject to any disclaimer, the term of this patent is extended or adjusted under 35 U.S.C. 154(b) by 831 days.

(21) Appl. No.: 10/972,667

(22) Filed: Oct. 25, 2004

(65) Prior Publication Data

US 2005/0108924 A1 May 26, 2005

(30) Foreign Application Priority Data

Oct. 25, 2003 (DE) ..... 103 49 850

(51) Int. Cl.
*C10L 1/18* (2006.01)
*C10L 1/22* (2006.01)

(52) U.S. Cl. ..... 44/393; 44/394; 44/395

(58) Field of Classification Search ..... 44/393, 44/394, 395

See application file for complete search history.

(56) References Cited

U.S. PATENT DOCUMENTS

| | | | | |
|---|---|---|---|---|
| 3,462,249 | A | 8/1969 | Tunkel | |
| 4,211,534 | A | 7/1980 | Feldman | |
| 4,608,411 | A | 8/1986 | Meunier | |
| 4,670,516 | A | 6/1987 | Sackmann | |
| 4,713,088 | A | 12/1987 | Tack et al. | |
| 4,810,260 | A | 3/1989 | Tack et al. | |
| 4,906,682 | A | 3/1990 | Mueller | |
| 4,985,048 | A * | 1/1991 | Wirtz et al. | 44/394 |
| 5,017,299 | A | 5/1991 | Gutierrez | |
| 5,045,088 | A | 9/1991 | Moore | |
| 5,178,641 | A | 1/1993 | Konrad | |
| 5,186,720 | A | 2/1993 | Feustel et al. | |
| 5,200,484 | A | 4/1993 | Reimann | |
| 5,254,652 | A | 10/1993 | Feustel et al. | |
| 5,275,747 | A | 1/1994 | Gutierrez | |
| 5,391,632 | A | 2/1995 | Krull et al. | |
| 5,413,725 | A | 5/1995 | Lal et al. | |
| 5,439,981 | A | 8/1995 | Balzer | |
| 5,441,545 | A | 8/1995 | Lewtas | |
| 5,733,346 | A | 3/1998 | Davies | |
| 5,743,923 | A | 4/1998 | Davies et al. | |
| 5,767,190 | A | 6/1998 | Krull et al. | |
| 5,789,510 | A | 8/1998 | Krull et al. | |
| 5,833,722 | A | 11/1998 | Davies | |
| 5,858,028 | A | 1/1999 | Davies | |
| 6,086,645 | A | 7/2000 | Quigley | |
| 6,162,772 | A | 12/2000 | Panagiotis | |
| 6,232,277 | B1 | 5/2001 | Ledeore | |
| 6,306,186 | B1 | 10/2001 | Davis | |
| 6,384,170 | B1 | 5/2002 | Krull et al. | |
| 6,409,778 | B1 | 6/2002 | Auschra et al. | |
| 6,458,175 | B1 | 10/2002 | Tack | |
| 6,461,393 | B1 | 10/2002 | Krull | |
| 6,509,424 | B1 | 1/2003 | Krull et al. | |
| 6,565,616 | B1 | 5/2003 | Krull | |
| 6,592,638 | B2 | 7/2003 | Krull | |
| 6,638,325 | B1 | 10/2003 | Brod | |
| 2001/0034308 | A1 | 10/2001 | Krull | |
| 2001/0034410 | A1 | 10/2001 | Krull | |
| 2002/0099228 | A1 | 7/2002 | Krull | |

(Continued)

FOREIGN PATENT DOCUMENTS

| | | |
|---|---|---|
| CA | 2008986 | 8/1990 |

(Continued)

OTHER PUBLICATIONS

I. M. El-Gamal, et al., "Polymeric structures as cold flow improvers for waxy residual fuel oil", Fuel 1997, vol. 76, No. 14/15, (1997), Elsevier.

(Continued)

*Primary Examiner*—Cephia D Toomer
(74) *Attorney, Agent, or Firm*—Richard P. Silverman

(57) ABSTRACT

The invention provides a fuel oil composition comprising a fuel oil of animal or vegetable origin and an additive comprising A) at least one copolymer of ethylene and 8-21 mol % of at least one acrylic or vinyl ester having a $C_1$-$C_{18}$-alkyl radical and B) at least one comb polymer containing structural units having $C_8$-$C_{16}$-alkyl radicals, the structural units being selected from $C_8$-$C_{16}$-alkyl (meth)acrylates, $C_8$-$C_{16}$-alkyl vinyl esters, $C_8$-$C_{16}$-alkyl vinyl ethers, $C_8$-$C_{16}$-alkyl (meth)acrylamides, $C_8$-$C_{16}$-alkyl allyl ethers and $C_8$-$C_{16}$-diketenes, where the sum R $$R = m_1 \cdot \sum_i w_{1i} \cdot n_{1i} + m_2 \cdot \sum_j w_{2j} \cdot n_{2j} + \ldots + m_g \cdot \sum_p w_{gp} \cdot n_{gp}$$

is the molar average of the carbon chain length distributions in the alkyl radicals of the monomers B) is from 11.0 to 14.0, where $m_1, m_2, \ldots m_g$ are the molar fractions of the abovementioned monomers B) in the polymer and the sum of the molar fractions $m_1$ to $m_g$=1, $w_{1i}, w_{1j} \ldots w_{2i}, w_{2j} \ldots w_{gp}$ are the proportions by weight of the individual chain lengths i, j, . . . p of the alkyl radicals of the different monomers B) 1 to g, and $n_{1i}, n_{1j} \ldots n_{2i}, n_{2j} \ldots n_{gp}$ are the chain lengths of the alkyl radicals i, j, . . . p of the monomers B) 1 to g.

40 Claims, No Drawings

U.S. PATENT DOCUMENTS

| | | | |
|---|---|---|---|
| 2003/0119992 | A1 | 6/2003 | Deneker |
| 2003/0136046 | A1 | 7/2003 | Jackson |
| 2004/0000612 | A1 | 1/2004 | Young |
| 2005/0108924 | A1 | 5/2005 | Krull |
| 2005/0113266 | A1 | 5/2005 | Krull |
| 2005/0126070 | A1 | 6/2005 | Krull |
| 2005/0126071 | A1 | 6/2005 | Krull |
| 2005/0137242 | A1 | 6/2005 | Siggelkow |
| 2007/0157509 | A1 | 7/2007 | Siggelkow |
| 2007/0161755 | A1 | 7/2007 | Siggelkow |

FOREIGN PATENT DOCUMENTS

| | | |
|---|---|---|
| CA | 2017126 | 11/1990 |
| CA | 2020104 | 12/1990 |
| CA | 2055417 | 5/1992 |
| DE | 3443 475 | 5/1986 |
| DE | 4134347 | 4/1993 |
| EP | 0203 554 | 12/1986 |
| EP | 308176 | 9/1987 |
| EP | 0254 284 | 1/1988 |
| EP | 0271 738 | 6/1988 |
| EP | 0629 231 | 12/1994 |
| EP | 0543 356 | 2/1997 |
| EP | 0922 716 | 6/1999 |
| EP | 1391498 | 2/2004 |
| JP | 10-237469 | 9/1998 |
| JP | 10-245574 | 9/1998 |
| JP | 11-181453 | 6/1999 |
| JP | 2002-338975 | 11/2002 |
| WO | WO 94/00516 | 6/1993 |
| WO | WO 93/14178 | 7/1993 |
| WO | WO 94/17159 | 8/1994 |
| WO | WO 01/38461 | 5/2001 |

OTHER PUBLICATIONS

Copending U.S. Appl. No. 11/803,786, filed May 16, 2007, to Bettina Siggelkow copy attached.
Copending U.S. Appl. No. 11/803,858, Filed May 16, 2007, to Bettina Siggelkow copy attached.
Copending U.S. Appl. No. 11/803,874, filed May 16, 2007, to Bettina Siggelkow copy attached.
Copending U.S. Appl. No. 11/803,798, filed May 16, 2007, to Bettina Siggelkow copy attached.
Abstract for DE3443 475, May 28, 1986.
Abstract for EP 0203 554, Dec. 3, 1986.
Abstract for EP 0254 284, Jan. 27, 1988.
Abstract for EP 0271 738, Jun. 22, 1988.
Abstract for EP 0543 356, Feb. 12, 1997.
Roempp Chemie Lexikon, 9th Ed., (1988-1992) vol. 4, pp. 3351-3354.
English Language Abstrac of DE 41 34 347, Apr. 22, 1993.
German Patent Office Office Action, Issued Apr. 25, 2006.

* cited by examiner

COLD FLOW IMPROVERS FOR FUEL OILS OF VEGETABLE OR ANIMAL ORIGIN

The present invention relates to an additive, to its use as a cold flow improver for vegetable or animal fuel oils and to correspondingly additized fuel oils.

In view of decreasing world crude oil reserves and the discussion about the environmentally damaging consequences of the use of fossil and mineral fuels, there is increasing interest in alternative energy sources based on renewable raw materials. These include in particular natural oils and fats of vegetable or animal origin. These are generally triglycerides of fatty acids having from 10 to 24 carbon atoms and a calorific value comparable to conventional fuels, but are at the same time regarded as being less harmful to the environment. Biofuels, i.e. fuels derived from animal or vegetable material, are obtained from renewable sources and, when they are combusted, generate only as much $CO_2$ as had previously been converted to biomass. It has been reported that less carbon dioxide is formed in the course of combustion than by the equivalent amount of crude oil distillate fuel, for example diesel fuel, and that very little sulfur dioxide is formed. In addition, they are biodegradable.

Oils obtained from animal or vegetable material are mainly metabolism products which include triglycerides of monocarboxylic acids, for example acids having from 10 to 25 carbon atoms, and corresponding to the formula

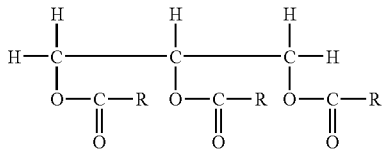

where R is an aliphatic radical which has from 10 to 25 carbon atoms and may be saturated or unsaturated.

In general, such oils contain glycerides from a series of acids whose number and type vary with the source of the oil, and they may additionally contain phosphoglycerides. Such oils can be obtained by processes known from the prior art.

As a consequence of the sometimes unsatisfactory physical properties of the triglycerides, the industry has applied itself to converting the naturally occurring triglycerides to fatty acid esters of low alcohols such as methanol or ethanol.

A hindrance to the use of triglycerides and also of fatty acid esters of lower monohydric alcohols as a replacement for diesel fuel alone or in a mixture with diesel fuel has proven to be the flow behavior at low temperatures. The cause of this is the high uniformity of these oils in comparison to mineral oil middle distillates. For example, the rapeseed oil methyl ester (RME) has a Cold Filter Plugging Point (CFPP) of −14° C. It has hitherto been impossible using the prior art additives to reliably obtain a CFPP value of −20° C. required for use as a winter diesel in Central Europe, or of −22° C. or lower for special applications. This problem is increased when oils are used which comprise relatively large amounts of the likewise readily available oils of sunflowers and soya.

EP-B-0 665 873 discloses a fuel oil composition which comprises a biofuel, a fuel oil based on crude oil and an additive which comprises (a) an oil-soluble ethylene copolymer or (b) a comb polymer or (c) a polar nitrogen compound or (d) a compound in which at least one substantially linear alkyl group having from 10 to 30 carbon atoms is bonded to a nonpolymeric organic radical, in order to provide at least one linear chain of atoms which includes the carbon atoms of the alkyl groups and one or more nonterminal oxygen atoms, or (e) one or more of the components (a), (b), (c) and (d).

EP-B-0 629 231 discloses a composition which comprises a relatively large proportion of oil which consists substantially of alkyl esters of fatty acids which are derived from vegetable or animal oils or both, mixed with a small proportion of mineral oil cold flow improvers which comprises one or more of the following:

(I) comb polymer, the copolymer (which may be esterified) of maleic anhydride or fumaric acid and another ethylenically unsaturated monomer, or polymer or copolymer of α-olefin, or fumarate or itaconate polymer or copolymer, (II) polyoxyalkylene ester, ester/ether or a mixture thereof, (III) ethylene/unsaturated ester copolymer, (IV) polar, organic, nitrogen-containing paraffin crystal growth inhibitor, (V) hydrocarbon polymer, (VI) sulfur-carboxyl compounds and (VII) aromatic pour point depressant modified with hydrocarbon radicals, with the proviso that the composition comprises no mixtures of polymeric esters or copolymers of esters of acrylic and/or methacrylic acid which are derived from alcohols having from 1 to 22 carbon atoms.

EP-B-0 543 356 discloses a process for preparing compositions having improved low temperature behavior for use as fuels or lubricants, starting from the esters of naturally occurring long-chain fatty acids with monohydric $C_1$-$C_6$-alcohols (FAE), which comprises a) adding PPD additives (pour point depressants) known per se and used for improving the low temperature behavior of mineral oils in amounts of from 0.0001 to 10% by weight, based on the long-chain fatty acid esters FAE and b) cooling the nonadditized long-chain fatty acid esters FAE to a temperature below the Cold Filter Plugging Point and c) removing the resulting precipitates (FAN).

DE-A-40 40 317 discloses mixtures of fatty acid lower alkyl esters having improved cold stability comprising a) from 58 to 95% by weight of at least one ester within the iodine number range from 50 to 150 and being derived from fatty acids having from 12 to 22 carbon atoms and lower aliphatic alcohols having from 1 to 4 carbon atoms, b) from 4 to 40% by weight of at least one ester of fatty acids having from 6 to 14 carbon atoms and lower aliphatic alcohols having from 1 to 4 carbon atoms and c) from 0.1 to 2% by weight of at least one polymeric ester.

EP-B-0 153 176 discloses the use of polymers based on unsaturated dialkyl $C_4$-$C_8$-dicarboxylates having an average alkyl chain length of from 12 to 14 as cold flow improvers for certain crude oil distillate fuel oils. Mentioned as suitable comonomers are unsaturated esters, in particular vinyl acetate, but also α-olefins.

EP-B-0 153 177 discloses an additive concentrate which comprises a combination of I) a copolymer having at least 25% by weight of an n-alkyl ester of a monoethylenically unsaturated $C_4$-$C_8$-mono- or -dicarboxylic acid, the average number of carbon atoms in the n-alkyl radicals being 12-14, and another unsaturated ester or an olefin, with II) another low temperature flow improver for distillate fuel oils.

WO 95/22300 (=EP 0 746 598) discloses comb polymers in-which the alkyl radicals have an average of less than 12 carbon atoms. These additives are especially suitable for oils having cloud points of less than −10° C., although the oils may also be native hydrocarbon oils (page 21, line 16 ff.). However, native oils have cloud points of about −2° C. upward.

EP-A-0 626 442 and EP-A-0 694 125 disclose fatty acid esters which comprise pour point depressants to improve the cold properties. The PPDs mentioned are: styrene-MA copolymers, esterified with a mixture of short-chain (butanol) and longer-chain $C_{10}$-$C_{18}$ alcohols, neutralized with aminopropylmorpholine; poly($C_{4-24}$-alkyl (meth)acrylates) and copolymers thereof with N-containing monomers; alkyl-bridged alkylaromatics.

EP-A-1 032 620 discloses poly(alkyl (meth)acrylates) having a broad carbon chain distribution and hydroxy-functional comonomers as an additive for mineral oil and biodiesel.

It has hitherto often been impossible using the existing additives to reliably adjust fatty acid esters to a CFPP value of −20° C. required for use as a winter diesel in Central Europe or of −22° C. and lower for special applications. An additional problem with the existing additives is the lacking cold temperature change stability of the additized oils, i.e. the CFPP value of the oils attained rises gradually when the oil is stored for a prolonged period at changing temperatures in the region of the cloud point or below.

It is therefore an object of the invention to provide additives for improving the cold flow behavior of fatty acid esters which are derived, for example, from rapeseed oil, sunflower oil and/or soya oil and attain CFPP values of −20° C. and below which remain constant even when the oil is stored for a prolonged period in the region of its cloud point or below.

It has now been found that, surprisingly, an additive comprising ethylene copolymers and comb polymers is an excellent flow improver for such fatty acid esters.

The invention therefore provides a fuel oil composition comprising a fuel oil of animal or vegetable origin and an additive comprising A) at least one copolymer of ethylene and 8-21 mol % of at least one acrylic or vinyl ester having a $C_1$-$C_{18}$-alkyl radical and B) at least one comb polymer containing structural units having $C_8$-$C_{16}$-alkyl radicals, the structural units being selected from $C_8$-$C_{16}$-alkyl(meth)acrylates, $C_8$-$C_{16}$-alkyl vinyl esters, $C_8$-$C_{16}$-alkyl vinyl ethers, $C_8$-$C_{16}$-alkyl (meth)acrylamides, $C_8$-$C_{16}$-alkyl allyl ethers and $C_8$-$C_{16}$-diketenes, where the sum R $$R = m_1 \cdot \sum_i w_{1i} \cdot n_{1i} + m_2 \cdot \sum_j w_{2j} \cdot n_{2j} + \ldots + m_g \cdot \sum_p w_{gp} \cdot n_{gp}$$

is the molar average of the carbon chain length distributions in the alkyl radicals of the monomers B) is from 11.0 to 14.0, where $m_1, m_2, \ldots m_g$ are the molar fractions of the abovementioned monomers B) in the polymer and the sum of the molar fractions $m_1$ to $m_g$=1, $w_{1i}, w_{1j}, w_{2i}, w_{2j} \ldots w_{gp}$ are the proportions by weight of the individual chain lengths i, j, . . . p of the alkyl radicals of the different monomers B) 1 to g, and $n_{1i}, n_{1j}, n_{2i}, n_{2j} \ldots n_{gp}$ are the chain lengths of the alkyl radicals i, j, . . . p of the monomers B) 1 to g.

The invention further provides an additive as defined above.

The invention further provides the use of the above-defined additive for improving the cold flow properties or fuel oils of animal or vegetable origin.

The invention further provides a process for improving the cold flow properties of fuel oils of animal or vegetable origin by adding the above-defined additive to fuel oils of animal or vegetable origin.

In a preferred embodiment of the invention, R has values of from 11.5 to 13.5, and especially from 12.0 to 13.0.

Useful ethylene copolymers A) are those which contain from 8 to 21 mol % of one or more vinyl and/or (meth)acrylic ester and from 79 to 92 mol % of ethylene. Particular preference is given to ethylene copolymers having from 10 to 18 mol % and especially from 12 to 16 mol %, of at least one vinyl ester. Suitable vinyl esters are derived from fatty acids having linear or branched alkyl groups having from 1 to 30 carbon atoms and preferably from 1 to 18, especially from 1 to 12 carbon atoms. Examples include vinyl acetate, vinyl propionate, vinyl butyrate, vinyl hexanoate, vinyl heptanoate, vinyl octanoate, vinyl laurate and vinyl stearate, and also esters of vinyl alcohol based on branched fatty acids, such as vinyl isobutyrate, vinyl pivalate, vinyl 2-ethylhexanoate, vinyl isononanoate, vinyl neononanoate, vinyl neodecanoate and vinyl neoundecanoate. Particular preference is given to vinyl acetate.

Likewise suitable as comonomers are esters of acrylic and methacrylic acids having from 1 to 20 carbon atoms in the alkyl radical, such as methyl (meth)acrylate, ethyl (meth) acrylate, propyl (meth)acrylate, n- and isobutyl (meth)acrylate, and hexyl, octyl, 2-ethylhexyl, decyl, dodecyl, tetradecyl, hexadecyl and octadecyl (meth)acrylate, and also mixtures of two, three, four or else more of these comonomers.

Apart from ethylene, particularly preferred terpolymers of vinyl 2-ethylhexanoate, of vinyl neononanoate or of vinyl neodecanoate contain preferably from 3.5 to 20 mol %, in particular from 8 to 15 mol %, of vinyl acetate, and from 0.1 to 12 mol %, in particular from 0.2 to 5 mol %, of the particular long-chain vinyl ester, the total comonomer content being between 8 and 21 mol %, preferably between 12 and 18 mol %. In addition to ethylene and from 8 to 18 mol % of vinyl esters, further preferred copolymers additionally contain from 0.5 to 10 mol % of olefins such as propene, butene, isobutylene, hexene, 4-methylpentene, octene, diisobutylene and/or norbomene.

The copolymers A preferably have molecular weights which correspond to melt viscosities at 140° C. of from 20 to 10 000 mPas, in particular from 30 to 5000 mPas, and especially from 50 to 1000 mPas. The degrees of branching determined by means of $^1$H NMR spectroscopy are preferably between 1 and 9 $CH_3$/100 $CH_2$ groups, in particular between 2 and 6 $CH_3$/100 $CH_2$ groups, for example from 2.5 to 5 $CH_3$/100 $CH_2$ groups, which do not stem from the comonomers.

The copolymers (A) can be prepared by customary copolymerization processes, for example suspension polymerization, solution polymerization, gas phase polymerization or high pressure bulk polymerization. Preference is given to carrying out the high pressure bulk polymerization at pressures of from 50 to 400 MPa, preferably from 100 to 300 MPa, and temperatures from 100 to 300° C., preferably from 150 to 220° C. In a particularly preferred preparation variant, the polymerization is effected in a multizone reactor in which the temperature difference between the peroxide feeds along the tubular reactor is kept very low, i.e. <50° C., preferably <30° C., in particular <15° C. The temperature maxima in the individual reaction zones preferably differ by less than 30° C., more preferably by less than 20° C. and especially by less than 10° C.

The reaction of the monomers is initiated by radical-forming initiators (radical chain initiators). This substance class includes, for example, oxygen, hydroperoxides, peroxides and azo compounds, such as cumene hydroperoxide, t-butyl hydroperoxide, dilauroyl peroxide, dibenzoyl peroxide, bis (2-ethylhexyl)peroxydicarbonate, t-butyl perpivalate, t-butyl permaleate, t-butyl perbenzoate, dicumyl peroxide, t-butyl cumyl peroxide, di(t-butyl)peroxide, 2,2'-azobis(2-methylpropanonitrile), 2,2'-azobis(2-methylbutyronitrile). The initiators are used individually or as a mixture of two or more substances in amounts of from 0.01 to 20% by weight, preferably from 0.05 to 10% by weight, based on the monomer mixture.

The high pressure bulk polymerization is carried out in known high pressure reactors, for example autoclaves or tubular reactors, batchwise or continuously, and tubular reactors have proven particularly useful. Solvents such as aliphatic and/or aromatic hydrocarbons or hydrocarbon mixtures, benzene or toluene may be present in the reaction mixture. Preference is given to the substantially solvent-free procedure. In a preferred embodiment of the polymerization, the mixture of the monomers, the initiator and, if used, the moderator, are fed to a tubular reactor via the reactor entrance and also via one or more side branches. Preferred moderators are, for example, hydrogen, saturated and unsaturated hydrocarbons, for example propane or propene, aldehydes, for example propionaldehyde, n-butyraldehyde or isobutyraldehyde, ketones, for example acetone, methyl ethyl ketone, methyl isobutyl ketone, cyclohexanone, and alcohols, for example butanol. The comonomers and also the moderators may be metered into the reactor either together with ethylene or else separately via sidestreams. The monomer streams may have different compositions (EP-A-0 271 738 and EP-A-0 922 716).

Examples of suitable co- or terpolymers include:

ethylene-vinyl acetate copolymers having 10-40% by weight of vinyl acetate and 60-90% by weight of ethylene; the ethylene-vinyl acetate-hexene terpolymers known from DE-A-34 43 475; the ethylene-vinyl acetate-diisobutylene terpolymers described in EP-B-0 203 554; the mixture of an ethylene-vinyl acetate-diisobutylene terpolymer and an ethylene/vinyl acetate copolymer known from EP-B-0 254 284; the mixtures of an ethylene-vinyl acetate copolymer and an ethylene-vinyl acetate-N-vinylpyrrolidone terpolymer disclosed in EP-B-0 405 270; the ethylene/vinyl acetate/isobutyl vinyl ether terpolymers described in EP-B-0 463 518; the ethylene/vinyl acetate/neononanoate or—vinyl neodecanoate terpolymers which, apart from ethylene, contain 10-35% by weight of vinyl acetate and 1-25% by weight of the particular neo compound, known from EP-B-0 493 769; the terpolymers of ethylene, a first vinyl ester having up to 4 carbon atoms and a second vinyl ester which is derived from a branched carboxylic acid having up to 7 carbon atoms or a branched but nontertiary carboxylic acid having from 8 to 15 carbon atoms, described in EP 0778875; the terpolymers of ethylene, the vinyl ester of one or more aliphatic $C_2$- to $C_{20}$-monocarboxylic acids and 4-methylpentene-1, described in DE-A-196 20 118; the terpolymers of ethylene, the vinyl ester of one or more aliphatic $C_2$- to $C_{20}$-monocarboxylic acids and bicyclo[2.2.1]hept-2-ene, disclosed in DE-A-196 20 119; the terpolymers of ethylene and at least one olefinically unsaturated comonomer which contains one or more hydroxyl groups, described in EP-A-0 926 168.

Preference is given to using mixtures of the same or different ethylene copolymers. The polymers on which the mixtures are based more preferably differ in at least one characteristic. For example, they may contain different comonomers, different comonomer contents, molecular weights and/or degrees of branching. The mixing ratio of the different ethylene copolymers is preferably between 20:1 and 1:20, preferably from 10:1 to 1:10, in particular from 5:1 to 1:5.

The copolymers B are derived from alkyl acrylates, alkyl methacrylates, alkylacrylamides, alkylmethacrylamides, alkyl vinyl esters, alkyl vinyl ethers, alkyl allyl ethers and also alkyl diketenes having from 8 to 16 carbon atoms in the alkyl radical. These comonomers are referred to hereinbelow as comonomers B1.

In a preferred embodiment, the copolymers which make up constituent B are those which contain comonomers which are derived from esters, amides and/or imides of ethylenically unsaturated monocarboxylic acids having from 3 to 8 carbon atoms with alcohols or amines, the alcohols or amines bearing alkyl radicals having from 8 to 16 carbon atoms.

Optionally, the copolymers B) may also contain comonomers B2) which are i) esters, amides and/or imides of ethylenically unsaturated dicarboxylic acids having from 4 to 8 carbon atoms and alcohols or amines having from 8 to 16 carbon atoms in the alkyl radicals and/or ii) $C_{10}$- to $C_{20}$-olefins.

The alkyl radicals of the comonomers B1 and B2 are preferably linear, but may also contain minor amounts of branched isomers of up to 30 mol %, preferably up to 20 mol % and in particular from 2 to 5 mol %.

The proportion of the comonomers B1) and optionally B2) in the polymer is preferably more than 50 mol %, in particular more than 70 mol % and especially at least 80 mol %, for example 90 to 95 mol %. The proportion of the monomers B2), where present, is preferably less than 80 mol %, in particular less than 50 mol % and especially less than 20 mol %, for example from 2 to 10 mol % of the total amount of the monomers B1) and B2). The polymers B) more preferably consist only of the monomers B1) and optionally B2) which then add up to 100 mol %.

Preferred monomers of the copolymers B) are esters of acrylic acid, methacrylic acid, maleic acid, fumaric acid and itaconic acid with octanol, nonanol, decanol, undecanol, dodecanol, n-tridecanol, isotridecanol, tetradecanol, pentadecanol, hexadecanol and mixtures thereof. Preferred monomers are also amides and optionally imides of these acids with octylamine, nonylamine, decylamine, undecylamine, dodecylamine, tridecylamine, tetradecylamine, pentadecylamine, hexadecylamine and mixtures thereof.

In a preferred embodiment, the copolymers which make up constituent B contain comonomers which are esters and/or ethers of ethylenically unsaturated alcohols having from 2 to 10 carbon atoms, and carboxylic acids or alcohols which bear alkyl radicals having from 8 to 16 carbon atoms.

Such preferred monomers of the copolymers B) are, for example, esters of vinyl alcohol with octanoic acid, 2-ethylhexanoic acid, nonanoic acid, neononanoic acid, decanoic acid, neodecanoic acid, undecanoic acid, neoundecanoic acid, dodecanoic acid, tridecanoic acid, tetradecanoic acid, pentadecanoic acid, hexadecanoic acid and mixtures thereof.

Further preferred monomers of the copolymers B) are, for example, ethers of allyl alcohol and especially of vinyl alcohol with octanol, nonanol, decanol, undecanol, dodecanol, n-tridecanol, isotridecanol, tetradecanol, pentadecanol, hexadecanol and mixtures thereof.

Likewise suitable as comonomers B2 are olefins having 10-20 carbon atoms, preferably having 12-18 carbon atoms and especially having 10-16 carbon atoms. These are preferably linear α-olefins having a terminal double bond. In a further preferred embodiment, they are branched olefins, especially oligomers of isobutylene and of propylene having from 10 to 20 carbon atoms.

Further monomers such as alkyl (meth)acrylates, alkyl vinyl esters, alkyl vinyl ethers having from 1 to 5 carbon atoms in the alkyl radical and ethylenically unsaturated free carboxylic acids, for example acrylic acid, methacrylic acid, maleic acid, fumaric acid, itaconic acid and monomers bearing functional groups, for example —OH, —SH, —N—, —CN, may likewise be present in the copolymers B in minor amounts of <20 mol %, <10 mol %, <5 mol %. Also present in minor amounts of up to 20 mol %, preferably <10 mol %, especially <5 mol % may be further comonomers which are copolymerizable with the monomers mentioned, for example allyl polyglycol ethers, styrenics and higher molecular weight olefins such as poly(isobutylene).

Alkyl polyglycol ethers correspond to the general formula

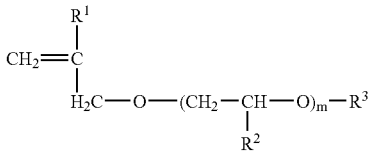

where $R^1$ is hydrogen or methyl, $R^2$ is hydrogen or $C_1$-$C_4$-alkyl, m is a number from 1 to 100, $R^3$ is $C_1$-$C_{24}$-alkyl, $C_5$-$C_{20}$-cycloalkyl, $C_6$-$C_{18}$-aryl or —C(O)—$R^4$, $R^4$ is $C_1$-$C_{40}$-alkyl, $C_5$-$C_{10}$-cycloalkyl or $C_6$-$C_{18}$-aryl.

All comonomers not falling under the above-specified definitions of B1) and/or B2) are not taken into account in the calculation of the factor R.

The inventive polymers may be prepared by direct polymerization from the monomers mentioned in known polymerization processes such as bulk, solution, emulsion, suspension or precipitation polymerization.

Equally, they may be prepared by derivatizing a base polymer bearing, for example, acid or hydroxyl groups with appropriate fatty acids, fatty alcohols or fatty amines having from 8 to 16 carbon atoms in the alkyl radical. The esterifications, etherifications, amidations and/or imidations are effected by known condensation processes. The derivatization may be complete or partial. Partially esterified or amidized, acid-based polymers have (without solvent) acid numbers of preferably 60-140 mg KOH/g and especially of 80-120 mg KOH/g. Copolymers having acid numbers of less than 80 mg KOH/g, especially less than 60 mg KOH/g are regarded as being fully derivatized. Polymers bearing partially esterified or etherified hydroxyl groups have OH numbers of from 40 to 200 mg KOH/g, preferably from 60 to 150 mg KOH/g; copolymers having hydroxyl numbers of less than 60 mg KOH/g and in particular less than 40 mg KOH/g are regarded as being fully derivatized. Particular preference is given to partially derivatized polymers.

Polymers which bear acid groups and are suitable for derivatization with fatty alcohols and/or amines to give esters and/or amides are homo- and copolymers of ethylenically unsaturated carboxylic acids, for example acrylic acid, methacrylic acid, maleic acid, fumaric acid, itaconic acid or reactive equivalents thereof, such as lower esters or anhydrides, for example methyl methacrylates and maleic anhydride, with one another and also with further monomers copolymerizable with these acids. Suitable examples are poly(acrylic acid), poly(methacrylic acid), poly(maleic acid), poly(maleic anhydride), poly(acrylic acid-co-maleic acid).

Suitable fatty alcohols and fatty amines are in particular linear, but they may also contain minor amounts, for example up to 30% by weight, preferably up to 20% by weight and especially up to 10% by weight, of branched alkyl radicals. The branches are preferably in the 1- or 2-position. Either shorter- or longer-chain fatty alcohols or fatty amines may be used, but their proportion is preferably below 20 mol % and especially below 10 mol %, for example between 1 and 5 mol %, based on the total amount of the amines used.

Particularly preferred fatty alcohols are octanol, decanol, undecanol, dodecanol, tridecanol, tetradecanol, pentadecanol and hexadecanol.

Suitable amines are primary and secondary amines having one or two $C_8$-$C_{16}$-alkyl radicals. They may bear one, two or three amino groups which are bonded via alkylene radicals having two or three carbon atoms. Preference is given to monoamines. Particularly preferred primary amines are octylamine, 2-ethylhexylamine, decylamine, undecylamine, dodecylamine, n-tridecylamine, isotridecylamine, tetradecylamine, pentadecylamine, hexadecylamine and mixtures thereof. Preferred secondary amines are dioctylamine, dinonylamine, didecylamine, didodecylamine, ditetradecylamine, dihexadecylamine, and also amines having different alkyl chain lengths, for example N-octyl-N-decylamine, N-decyl-N-dodecylamine, N-decyl-N-tetradecylamine, N-decyl-N-hexadecylamine, N-dodecyl-N-tetradecylamine, N-dodecyl-N-hexadecylamine, N-tetradecyl-N-hexadecylamine. Also suitable in accordance with the invention are secondary amines which, in addition to a $C_8$-$C_{16}$-alkyl radical, bear shorter side chains having from 1 to 5 carbon atoms, for example methyl or ethyl groups. In the case of secondary amines, it is the average of the alkyl chain lengths of from $C_8$ to $C_{16}$ that is taken into account as the alkyl chain length n for the calculation of the Q factor. Neither shorter nor longer alkyl radicals, where present, are taken into account in the calculation, since they do not contribute to the effectiveness of the additives. The proportion of shorter and longer alkyl chains is therefore preferably below 20 mol %, preferably below 10 mol %, based on the total amount of amine used. Particular preference is given to amides and imides derived from primary monoamines.

Polymers which bear hydroxyl groups and are particularly suitable for the derivatization with fatty acids and/or fatty alcohols to give esters and/or ethers are homo- and copolymers of monomers bearing hydroxyl groups such as vinyl alcohol, allyl alcohol or else hydroxyethyl acrylate, hydroxyethyl methacrylate, hydroxypropyl acrylate and hydroxypropyl methacrylate. Suitable fatty acids have from 8 to 16 carbon atoms in the alkyl radical. The alkyl radical is substantially linear, but may also contain minor amounts, for example up to 30% by weight, preferably up to 20% by weight and especially up to 10% by weight, of branched isomers. Particularly suitable are nonanoic acid, decanoic acid, undecanoic acid, dodecanoic acid, tridecanoic acid, tetradecanoic acid, pentadecanoic acid, hexadecanoic acid, heptadecanoic acid and octadecanoic acid and nonadecanoic acid and mixtures thereof.

The use of mixtures of different fatty acids, alcohols and/or amines in the esterification, etherification, amidation or imidation allows the effectiveness of the inventive additives to be further adapted to specific fatty acid ester compositions.

The molecular weights of the inventive copolymers B are between 1000 and 100 000 g/mol, in particular between 2000 and 50 000 g/mol and especially between 2500 and 25 000 g/mol, measured by means of gel-permeation chromatography (GPC) against poly(styrene). Inventive copolymers B have to be oil-soluble in dosages relevant to the practice, i.e. they have to dissolve without residue in the oil to be additized at 50° C.

In a preferred embodiment, mixtures of the copolymers B according to the invention are used, with the proviso that the mean of the R values of the mixing components in turn assumes values of from 11 to 14, preferably from 11.5 to 13.5 and in particular values from 12.0 to 13.0.

The mixing ratio of the additives A and B according to the invention is (in parts by weight) from 20:1 to 1:20, preferably from, 10:1 to 1:10, in particular from 5:1 to 1:2.

The additives according to the invention are added to oils in amounts of from 0.001 to 5% by weight, preferably from 0.005 to 1% by weight and especially from 0.01 to 0.5% by weight. They may be used as such or else dissolved or dispersed in solvents, for example aliphatic and/or aromatic hydrocarbons or hydrocarbon mixtures, for example toluene, xylene, ethylbenzene, decane, pentadecane, petroleum fractions, kerosene, naphtha, diesel, heating oil, isoparaffins or commercial solvent mixtures such as Solvent Naphtha, ®Shellsol AB, ®Solvesso 150, ®Solvesso 200, ®Exxsol, ®Isopar and ®Shellsol D types. They are preferably dissolved in fuel oil of animal or vegetable origin based on fatty acid alkyl esters. The additives according to the invention preferably comprise 1-80%, especially 10-70%, in particular 25-60% (m/m), of solvent.

In a preferred embodiment, the fuel oil, which is frequently also referred to as biodiesel or biofuel, is a fatty acid alkyl ester made from fatty acids having from 12 to 24 carbon atoms and alcohols having from 1 to 4 carbon atoms. Typically, a relatively large portion of the fatty acids contains one, two or three double bonds.

Examples of oils which are derived from animal or vegetable material and in which the additive according to the invention can be used are rapeseed oil, coriander oil, soya oil, cottonseed oil, sunflower oil, castor oil, olive oil, peanut oil, maize oil, almond oil, palmseed oil, coconut oil, mustardseed oil, bovine tallow, bone oil, fish oils and used cooking oils. Further examples include oils which are derived from wheat, jute, sesame, shea tree nut, arachis oil and linseed oil. The fatty acid alkyl esters also referred to as biodiesel can be derived from these oils by processes known from the prior art. Rapeseed oil, which is a mixture of fatty acids partially esterified with glycerol, is preferred, since it is obtainable in large amounts and is obtainable in a simple manner by extractive pressing of rapeseeds. In addition, preference is given to the likewise widely available oils of sunflowers and soya, and also to their mixtures with rapeseed oil.

Particularly suitable biofuels are low alkyl esters of fatty acids. These include, for example, commercially available mixtures of the ethyl, propyl, butyl and in particular methyl esters of fatty acids having from 14 to 22 carbon atoms, for example of lauric acid, myristic acid, palmitic acid, palmitolic acid, stearic acid, oleic acid, elaidic acid, petroselic acid, ricinolic acid, elaeostearic acid, linolic acid, linolenic acid, eicosanoic acid, gadoleic acid, docosanoic acid or erucic acid, each of which preferably has an iodine number of from 50 to 150, in particular from 90 to 125. Mixtures having particularly advantageous properties are those which comprise mainly, i.e. comprise at least 50% by weight, methyl esters of fatty acids having from 16 to 22 carbon atoms, and 1, 2 or 3 double bonds. The preferred lower alkyl esters of fatty acids are the methyl esters of oleic acid, linoleic acid, linolenic acid and erucic acid.

Commercial mixtures of the type mentioned are obtained, for example, by hydrolyzing and esterifying or by transesterifying animal and vegetable fats and oils with lower aliphatic alcohols. Equally suitable as starting materials are used cooking oils. To prepare lower alkyl esters of fatty acids, it is advantageous to start from fats and oils having a high iodine number, for example sunflower oil, rapeseed oil, coriander oil, castor oil, soya oil, cottonseed oil, peanut oil or bovine tallow. Preference is given to lower alkyl esters of fatty acids based on a novel type of rapeseed oil, more than 80% by weight of whose fatty acid component is derived from unsaturated fatty acids having 18 carbon atoms.

A biofuel is therefore an oil which is obtained from vegetable or animal material or both or a derivative thereof which can be used as a fuel and in particular as a diesel or heating oil. Although many of the above oils can be used as biofuels, preference is given to vegetable oil derivatives, and particularly preferred biofuels are alkyl ester derivatives of rapeseed oil, cottonseed oil, soya oil, sunflower oil, olive oil or palm oil, and very particular preference is given to rapeseed oil methyl ester, sunflower oil methyl ester and soya oil methyl ester. Particularly preferred biofuels or components in the biofuel are additionally also used fatty acid esters, for example used fatty acid methyl esters.

The additive can be introduced into the oil to be additized in accordance with prior art processes. When more than one additive component or coadditive component is to be used, such components can be introduced into the oil together or separately in any desired combination.

The additives according to the invention allow the CFPP value of biodiesel to be adjusted to values of below −20° C. and sometimes to values of below −25° C., as required for provision on the market for use in winter in particular. Equally, the pour point of biodiesel is reduced by the addition of the inventive additives. The inventive additives are particularly advantageous in problematic oils which contain a high proportion of esters of saturated fatty acids of more than 4%, in particular of more than 5% and especially having from 7 to 25%, for example having from 8 to 20%, as present, for example, in oils from sunflowers and soya. Such oils are characterized by cloud points of above −5° C. and especially of above −3° C. It is thus also possible using the inventive additives to adjust mixtures of rapeseed oil methyl ester and sunflower and/or soya oil fatty acid methyl ester to CFPP values of −20° C. and below. In addition, the oils additized in this way have a good cold temperature change stability, i.e. the CFPP value remains constant even on storage under winter conditions.

To prepare additive packages for specific solutions to problems, the additives according to the invention can also be used together with one or more oil-soluble coadditives which alone improve the cold flow properties of crude oils, lubricant oils or fuel oils. Examples of such coadditives are polar compounds which effect paraffin dispersion (paraffin dispersants) and also oil-soluble amphiphiles.

Paraffin dispersants reduce the size of the paraffin crystals and have the effect that the paraffin particles do not separate but remain dispersed colloidally with a distinctly reduced tendency to sedimentation. Useful paraffin dispersants have proven to be both low molecular weight and polymeric oil-soluble compounds having ionic or polar groups, for example amine salts and/or amides. Particularly preferred paraffin dispersants comprise reaction products of secondary fatty amines having from 20 to 44 carbon atoms, in particular dicocoamine, ditallow fat amine, distearylamine and dibehenylamine with carboxylic acids and derivatives thereof. Paraffin dispersants which are obtained by reacting aliphatic or aromatic amines, preferably long-chain aliphatic amines, with aliphatic or aromatic mono-, di-, tri- or tetracarboxylic acids or their anhydrides (cf. U.S. Pat. No. 4,211,534) have proven particularly useful. Equally suitable as paraffin dispersants are amides and ammonium salts of aminoalkylene polycarboxylic acids such as nitrilotriacetic acid or ethylenediaminetetraacetic acid with secondary amines (cf. EP 0 398 101). Other paraffin dispersants are copolymers of maleic anhydride and α, β-unsaturated compounds which may optionally be reacted with primary monoalkylamines and/or aliphatic alcohols (cf. EP 0 154 177) and the reaction products of alkenyl-spiro-bislactones with amines (cf. EP 0 413 279 B1) and, according to EP 0 606 055 A2, reaction products of terpolymers based on α,β-unsaturated dicarboxylic anhydrides, α,β-unsaturated compounds and polyoxyalkylene ethers of lower unsaturated alcohols.

The mixing ratio (in parts by weight) of the additives according to the invention with paraffin dispersants is from 1:10 to 20:1, preferably from 1:1 bis 10:1.

The additives can be used alone or else together with other additives, for example with other pour point depressants or dewaxing assistants, with antioxidants, cetane number improvers, dehazers, demulsifiers, detergents, dispersants, defoamers, dyes, corrosion inhibitors, conductivity improvers, sludge inhibitors, odorants and/or additives for reducing the cloud point.

EXAMPLES

Characterization of the Test Oils:

The CFPP value is determined to EN 116 and the cloud point is determined to ISO 3015.

TABLE 1

Characterization of the test oils used

| Oil No. | | CP | CFPP |
|---|---|---|---|
| E 1 | Rapeseed oil methyl ester | −2.3 | −14° C. |
| E 2 | 80% of rapeseed oil methyl ester + 20% of sunflower oil methyl ester | −1.6 | −10° C. |
| E 3 | 90% of rapeseed oil methyl ester + 10% of soya oil methyl ester | −2.0 | −8° C. |

TABLE 2

Carbon chain distribution of the fatty acid methyl esters used to prepare the test oils (main constituents; area % by GC):

| | $C_{16}$ | $C_{16}'$ | $C_{18}$ | $C_{18}'$ | $C_{18}''$ | $C_{18}'''$ | $C_{20}$ | $C_{20}'$ | $C_{22}$ | Σ saturated |
|---|---|---|---|---|---|---|---|---|---|---|
| RME | 4.4 | 0.4 | 1.6 | 57.8 | 21.6 | 8.8 | 1.5 | 0.7 | 0.2 | 7.7 |
| SFME | 6.0 | 0.1 | 3.8 | 28.7 | 58.7 | 0.1 | 0.3 | 0.3 | 0.7 | 10.8 |
| SoyaME | 10.4 | 0.1 | 4.1 | 24.8 | 51.3 | 6.9 | 0.5 | 0.4 | 0.4 | 15.4 |

RME = rapeseed oil methyl ester;
SFME = sunflower oil methyl ester
SoyaME = soya oil methyl ester The following additives were used:

Ethylene copolymers A

The ethylene copolymers used are commercial products having the characteristics specified in Table 2. The products were used as 65% or 50% (A3) dilutions in kerosene.

TABLE 3

Characterization of the ethylene copolymers used

| Example | Comonomer(s) | V140 | $CH_3$/ 100 $CH_2$ |
|---|---|---|---|
| A1 | 13.6 mol % of vinyl acetate | 130 mPas | 3.7 |
| A2 | 13.7 mol % of vinyl acetate and 1.4 mol % of vinyl neodecanoate | 105 mPas | 5.3 |
| A3 | 9.4 mol % of vinyl acetate | 220 mPas | 6.2 |
| A4 | Mixture of EVA copolymer having 16 mol % of vinyl acetate with EVA having 5 mol % of vinyl acetate in a 13:1 ratio | 95 mPas/ 350 mPas | 3.2/5.7 |

Comb Polymers B

Different co- and terpolymers having the molar ratios of the monomers specified in Table 3 and the R factors calculated therefrom were investigated. The polymers were used in the form of 50% dilutions in a relatively high-boiling aromatic solvent. The acid numbers determined are based on these 50% dilutions.

TABLE 4

Characterization of the comb polymers used

| Example | Comonomers | R | Acid number [mg KOH/g] |
|---|---|---|---|
| B1 | Poly(decyl acrylate-co-tetradecyl acrylate) composed of 50% decyl acrylate and 50% tetradecyl acrylate, Mw 9200 | 12.0 | 2.5 |
| B2 | Poly(dodecyl acrylate-co-tetradecyl acrylate) composed of 70% dodecyl acrylate and 30% tetradecyl acrylate, having Mw 10 500 | 12.6 | 1.2 |
| B3 | Poly(dodecyl methacrylate) having Mw 22 000 | 12.0 | 1.7 |
| B4 | Poly(vinyl laurate-co-decyl acrylate) composed of 40% vinyl laurate and 60% decyl acrylate, Mw 7500 | 11.6 | 3.0 |
| B5 | Poly(2-ethylhexyl acrylate-co-tetradecyl acrylate) composed of 10% 2-ethylhexyl acrylate and 90% tetradecyl acrylate, having Mw 6400 | 13.4 | 10 |
| B6 | Poly(dodecyl vinyl ether-co-decyl methacrylate) composed of equal proportions of dodecyl vinyl ether and decyl methacryate, having Mw 5200 | 11.0 | 2.8 |
| B7 | Poly(acrylic acid) esterified with a mixture of 75% dodecanol and 25% hexadecanol, Mw 15 000 | 13.0 | 43 |
| B8 | Poly(acrylic acid) esterified with a mixture of 40% decanol, 30% dodecanol and 30% tetradecanol, Mw 24 000 | 11.8 | 51 |
| B9 | Poly(acrylic acid-co-maleic acid) esterified with a mixture of 55% decanol and 45% hexadecanol, Mw 19 000 | 12.7 | 34 |
| B10 (Comp.) | Poly(acrylic acid) esterified with a mixture of 30% octanol, 30% decanol and 40% dodecanol, Mw 23 000 | 10.2 | 42 |
| B11 (Comp.) | Poly(decyl acrylate) having Mw 19 000 | 10.0 | 2.3 |
| B12 (Comp.) | Poly(tetradecyl acrylate-co-hexadecyl acrylate) having equal proportions of tetradecyl and hexadecyl acrylate, Mw 24 000 | 15.0 | 1.6 |
| B13 (Comp.) | Alternating poly(ditetradecyl fumarate-alt-vinyl acetate) | 14.0 | 0.4 |

Effectiveness of the Terpolymers

The CFPP value (to EN 116, in ° C.) of different biofuels according to the above table was determined after the addition of 1200 ppm, 1500 ppm and also 2000 ppm, of additive mixture. Percentages relate to parts by weight in the particular additive mixtures. The results reported in Tables 5 to 7 show that comb polymers having the factor R according to the invention achieve excellent CFPP reductions even at low dosages and offer additional potential at higher dosages.

TABLE 5

CFPP testing in test oil E1

| Ex. | Ethylene copolymer A | Comb polymer B | CFPP in test oil 1 1200 ppm | 1500 ppm | 2000 ppm |
|---|---|---|---|---|---|
| 1 | 80% A1 | 20% B1 | −20 | −23 | −24 |
| 2 | 80% A1 | 20% B2 | −21 | −24 | −27 |
| 3 | 80% A1 | 20% B3 | −21 | −24 | −26 |
| 4 | 80% A1 | 20% B4 | −20 | −23 | −25 |
| 5 | 80% A1 | 20% B5 | −20 | −21 | −23 |
| 6 | 80% A1 | 20% B6 | −19 | −20 | −22 |
| 7 | 80% A1 | 20% B7 | −21 | −24 | −28 |
| 8 | 80% A1 | 20% B8 | −21 | −25 | −27 |
| 9 | 80% A1 | 20% B9 | −21 | −24 | −28 |
| 10 (Comp.) | 80% A3 | 20% B9 | −19 | −19 | −21 |
| 11 (Comp.) | 80% A1 | 20% B10 | −17 | −17 | −18 |
| 12 (Comp.) | 80% A1 | 20% B12 | −18 | −17 | −19 |
| 13 (Comp.) | 80% A1 | 20% B13 | −18 | −18 | −17 |
| 14 (Comp.) | 100% A1 | — | −16 | −18 | −17 |
| 15 (C) | | 100% A2 | −15 | −18 | −17 |

TABLE 6

CFPP testing in test oil E2

| Ex. | Ethylene copolymer A | Comb polymer B | CFPP in test oil 2 1200 ppm | 1500 ppm | 2000 ppm |
|---|---|---|---|---|---|
| 16 | 70% A2 | 30% B1 | −21 | −25 | −27 |
| 17 | 70% A2 | 30% B2 | −21 | −24 | −28 |
| 18 | 70% A2 | 30% B3 | −21 | −23 | −26 |
| 19 | 70% A2 | 30% B4 | −20 | −23 | −24 |
| 20 | 70% A2 | 30% B5 | −20 | −22 | −23 |
| 21 | 70% A2 | 30% B6 | −19 | −21 | −22 |
| 22 | 70% A2 | 30% B7 | −20 | −23 | −25 |
| 23 | 70% A2 | 30% B8 | −20 | −23 | −26 |
| 24 | 70% A2 | 30% B9 | −21 | −24 | −27 |
| 25 | 50% A2 | 50% B9 | −20 | −23 | −25 |
| 26 (Comp.) | 70% A2 | 30% B11 | −15 | −17 | −19 |
| 27 (Comp.) | 70% A2 | 30% B12 | −12 | −14 | −15 |
| 28 (Comp.) | 70% A2 | 30% B13 | −16 | −18 | −19 |
| 29 (Comp.) | 100% A2 | — | −12 | −13 | −12 |

TABLE 7

CFPP testing in test oil E3

| Ex. | Ethylene copolymer A | Comb polymer B | CFPP in test oil E3 1500 ppm | 2000 ppm |
|---|---|---|---|---|
| 30 | 70% A2 | 30% B2 | −20 | −25 |
| 31 | 70% A2 | 30% B3 | −19 | −24 |
| 32 | 70% A2 | 30% B4 | −20 | −26 |
| 33 | 70% A2 | 30% B9 | −20 | −25 |
| 34 (Comp.) | 70% A2 | 30% B11 | −16 | −17 |
| 35 (Comp.) | 70% A2 | 30% B12 | −16 | −13 |

TABLE 7-continued

| CFPP testing in test oil E3 | | | | |
|---|---|---|---|---|
| | Ethylene | Comb | CFPP in test oil E3 | |
| Ex. | copolymer A | polymer B | 1500 ppm | 2000 ppm |
| 36 (Comp.) | 70% A2 | 30% B13 | −15 | −15 |
| 36 (Comp.) | 100% A2 | — | −14 | −13 |

Cold Temperature Change Stability of Fatty Acid Methyl Esters

To determine the cold temperature change stability of an oil, the CFPP value of DIN EN 116 before and after a standardized cold temperature change treatment are compared.

500 ml of biodiesel (test oil E1) are treated with the appropriate cold temperature additive, introduced into a measuring cylinder and stored in a programmable cold chamber for a week. Within this time, a program is run through which repeatedly cools to −13° C. and then heats back to −3° C. 6 of these cycles are run through in succession (Table 8).

TABLE 8

| Cooling program for determining the cold temperature change stability: | | | | |
|---|---|---|---|---|
| Section | Time | End | Duration | Description |
| A → B | +5° C. | −3° C. | 8 h | Precooling to cycle start temperature |
| B → C | −3° C. | −3° C. | 2 h | Constant temperature, beginning of cycle |
| C → D | −3° C. | −13° C. | 14 h | Temperature reduction, commencement of crystal formation |
| D → E | −13° C. | −13° C. | 2 h | Constant temperature, crystal growth |
| E → F | −13° C. | −3° C. | 6 h | Temperature increase, melting of the crystals |
| F → B | | | | 6 further B → F cycles are carried out. |

Subsequently, the additized oil sample is heated to room temperature without agitation. A sample of 50 ml is taken for CFPP measurements from each of the upper, middle and lower sections of the measuring cylinder.

A deviation between the mean values of the CFPP values after storage and the CFPP value before storage and also between the individual phases of less than 3 K shows a good cold temperature change stability.

What is claimed is:

1. A fuel oil composition comprising a fuel oil of animal or vegetable origin and an additive comprising A) at least one copolymer of ethylene and 8-21 mol % of at least one acrylic or vinyl ester having a $C_1$-$C_{18}$-alkyl radical and B) at least one comb polymer containing structural units derived from monomers having $C_8$-$C_{16}$-alkyl radicals, the monomers being selected from the group consisting of $C_8$-$C_{16}$-alkyl (meth)acrylates, $C_8$-$C_{16}$-alkyl vinyl esters, $C_8$-$C_{16}$-alkyl vinyl ethers, $C_8$-$C_{16}$-alkyl (meth) acrylamides, $C_8$-$C_{16}$-alkyl allyl ethers, $C_8$-$C_{16}$-diketenes and mixtures thereof, where the sum R $$R = m_1 \cdot \sum_i w_{1i} \cdot n_{1i} + m_2 \cdot \sum_j w_{2j} \cdot n_{2j} + \ldots + m_g \cdot \sum_p w_{gp} \cdot n_{gp}$$

is the molar average of carbon chain length distributions in the alkyl radicals of the monomers of B) and R is from 11.0 to 14.0, where $m_1, m_2, \ldots m_g$ are the molar fractions of the monomers of B) in the comb polymer and the sum of the molar fractions $m_1$ to $m_g$=1, $w_{1i}, w_{1j} \ldots w_{2i}, w_{2j} \ldots w_{gp}$ are the proportions by weight of individual carbon chain lengths i, j, . . . p of said alkyl radicals of the monomers of B) 1 to g, and $n_{1i}, n_{1j} \ldots n_{2i}, n_{2j} \ldots n_{gp}$ are the carbon chain lengths of said alkyl radicals i, j, . . . p of the monomers of B) 1 to g.

2. A fuel oil composition as claimed in claim 1, wherein R is from 11.5 to 13.5.

3. A fuel oil composition of claim 1, wherein, apart from ethylene, constituent A comprises from 3.5 to 20 mol % of a first comonomer consisting of vinyl acetate and from 0.1 to 12 mol % of a further comonomer selected from the group consisting of vinyl neononanoate, vinyl 2-ethylhexanoate, vinyl neodecanoate, and mixtures thereof, and constituent A comprises a total comonomer content between 8 and 21 mol %.

4. A fuel oil composition of claim 1, wherein, in addition to ethylene and from 8 to 18 mol % of vinyl esters, constituent A also comprises from 0.5 to 10 mol % of olefins selected from the group consisting of propene, butene, isobutylene, hexene, 4-methylpentene, octene, diisobutylene, norbornene, and mixtures thereof.

5. A fuel oil composition of claim 1, wherein constituent A has a melt viscosity of between 20 and 10,000 mPas.

6. A fuel oil composition of claim 1, wherein constituent A has a degree of branching of between 1 and 9 $CH_3$/100 $CH_2$ groups which do not stem from said alkyl radical.

TABLE 9

| Cold temperature change stability of the additized oil: | | | | | | | | | | |
|---|---|---|---|---|---|---|---|---|---|---|
| | Additive | | | CFPP | CFPP after storage | | | | | |
| Example | Ethylene copolymer A | Comb polymer B | Dosage | before storage | Lower | Δ CFPP (lower) | middle | Δ CFPP (middle) | upper | Δ CFPP (upper) |
| 37 | 80% A1 | 20% B2 | 1500 ppm | −24° C. | −23° C. | +1 K | −24° C. | 0 K | −24.5° C. | −0.5 K |
| 38 | 80% A4 | 20% B9 | 1500 ppm | −24° C. | −23.5° C. | 0.5 K | −24° C. | 0 K | −25° C. | −1 K |
| 39 (V) | A4 | — | 2500 ppm | −20° C. | −12° C. | 8 K | −12.5° C. | 7.5 K | −14° C. | 6 K |

The CFPP values reported are mean values of a double determination

7. A fuel oil composition of claim 1, where the monomers of comb polymer B are derived from the group consisting of esters, amides, and mixtures thereof of ethylenically unsaturated carboxylic acids having from 3 to 8 carbon atoms and alcohols or amines having alkyl radicals of from 8 to 16 carbon atoms.

8. A fuel oil composition of claim 1, wherein the monomers of comb polymer B are derived from esters or ethers or mixtures of esters and ethers of ethylenically unsaturated alcohols having from 2 to 10 carbon atoms and carboxylic acids or alcohols having alkyl radicals of from 8 to 16 carbon atoms.

9. A fuel oil composition of claim 1, wherein the monomers of comb polymer B further comprise comonoer B2) derived from the group consisting of esters, amides, imides, and mixtures thereof of ethylenically unsaturated dicarboxylic acids having from 4 to 8 carbon atoms and alcohols or amines having alkyl radicals of from 8 to 16 carbon atoms.

10. A fuel oil composition of claim 1, wherein the monomers of comb polymer B further comprise comonomer B2) derived from α-olefins having 10 to 20 carbon atoms.

11. A fuel oil composition of claim 1, wherein the monomers of comb polymer B contain substantially linear alkyl radicals.

12. A fuel oil composition of claim 1, wherein the average molecular mass of the comb polymer B is between 1000 and 100 000 g/mol.

13. A fuel oil composition of claim 1, further comprising polar nitrogen-containing paraffin dispersants.

14. A fuel oil composition of claim 1, wherein the fuel oil of animal or vegetable origin comprises one or more esters of monocarboxylic acid having from 14 to 24 carbon atoms and alcohol having from 1 to 4 carbon atoms.

15. A fuel oil composition of claim 14, wherein the alcohol is methanol or ethanol.

16. A fuel oil composition of claim 1, wherein the fuel oil of animal or vegetable origin contains more than 5% by weight of esters of saturated fatty acids.

17. A process to improve the cold flow properties of fuel oils of animal or vegetable origin, said process comprising adding to said fuel oils an additive comprising:

A) at least one copolymer of ethylene and 8-21 mol % of at least one acrylic or vinyl ester having a $C_1$-$C_{18}$-alkyl radical and B) at least one comb polymer containing structural units derived from monomers having $C_8$-$C_{16}$-alkyl radicals, the monomers being selected from the group consisting of $C_8$-$C_{16}$-alkyl (meth)acrylates, $C_8$-$C_{16}$-alkyl vinyl esters, $C_8$-$C_{16}$-alkyl vinyl ethers, $C_8$-$C_{16}$-alkyl (meth) acrylamides, $C_8$-$C_{16}$-alkyl allyl ethers, $C_8$-$C_{16}$-diketenes, and mixtures thereof, and where R is a sum $$R = m_1 \cdot \sum_i w_{1i} \cdot n_{1i} + m_2 \cdot \sum_j w_{2j} \cdot n_{2j} + \ldots + m_g \cdot \sum_p w_{gp} \cdot n_{gp}$$

of molar average of carbon chain length distributions in the alkyl radicals of the comonomers of comb polymer B) and R ranges from 11.0 to 14.0, where $m_1, m_2, \ldots m_g$ are molar fractions of the monomers of B) in the comb polymer and wherein a sum of the molar fractions $m_1$ to $m_g$=1, $w_{1i}, w_{1j} \ldots w_{2i}, w_{2j} \ldots w_{gp}$ are proportions by weight of the individual carbon chain lengths i, j, . . . p of the alkyl radicals of the different monomers of B) 1 to g, and $n_{1i}, n_{1j} \ldots n_{2i}, n_{2j} \ldots n_{gp}$ are carbon chain lengths of the alkyl radicals i, j, . . . p of the monomers of B) 1 to g.

18. An additive comprising

A) at least one copolymer of ethylene and 8-21 mol % of at least one acrylic or vinyl ester having a $C_1$-$C_{18}$-alkyl radical and B) at least one comb polymer containing structural units derived from monomers having $C_8C_{16}$-alkyl radicals, the monomers being selected from the group consisting of $C_8$-$C_{16}$-alkyl(meth)acrylamides, $C_8$-$C_{16}$-alkyl vinyl esters, $C_8$-$C_{16}$-alkyl vinyl ethers, $C_8$-$C_{16}$-alkyl(meth) acrylamides, $C_8$-$C_{16}$-alkyl allyl ethers, $C_8$-$C_{16}$-diketenes, and mixtures thereof, wherein R is a sum $$R = m_1 \cdot \sum_i w_{1i} \cdot n_{1i} + m_2 \cdot \sum_j w_{2j} \cdot n_{2j} + \ldots + m_g \cdot \sum_p w_{gp} \cdot n_{gp}$$

of a molar average of carbon chain length distributions in the alkyl radicals of the monomers of B) and ranges from 11.0 to 14.0, where $m_1, m_2, \ldots m_g$ are molar fractions of the monomers of B) in the comb polymer and wherein a sum of molar fractions $m_1$ to $m_g$=1, $w_{1i}, w_{1j} \ldots w_{2i}, w_{2j} \ldots w_{gp}$ are proportions by weight of the individual carbon chain lengths i, j, . . . p of the alkyl radicals of the different monomers of B) 1 to g, and $n_{1i}, n_{1j} \ldots n_{2i}, n_{2j} \ldots n_{gp}$ are carbon chain lengths of the alkyl radicals i, j, . . . p of the monomers of B) 1 to g.

19. The process of claim 17, wherein R is from 11.5 to 13.5.

20. The process of claim 17, wherein, apart from ethylene, constituent A comprises from 3.5 to 20 mol % of a first comonomer consisting of vinyl acetate and from 0.1 to 12 mol % of a further comonomer selected from the group consisting of vinyl neononanoate, vinyl 2-ethylhexanoate, vinyl neodecanoate, and mixtures thereof, and constituent A comprises a total comonomer content between 8 and 21 mol %.

21. The process of claim 17, wherein, in addition to ethylene and from 8 to 18 mol % of vinyl esters, constituent A also comprises from 0.5 to 10 mol % of olefins selected from the group consisting of propene, butene, isobutylene, hexene, 4-methylpentene, octene, dilsobutylene, norbomene, and mixtures thereof.

22. The process of claim 17, wherein constituent A has a melt viscosity of between 20 and 10 000 mPas.

23. The process of claim 17, wherein constituent A has a degree of branching of between 1 and 9 $CH_3$/100 CH2 groups which do not stem from said alkyl radical.

24. The process of claim 17, where the monomers of comb polymer B are derived from the group consisting of esters, amides, and mixtures thereof of ethylenically unsaturated carboxylic acids having from 3 to 8 carbon atoms and alcohols or amines having alkyl radicals of from 8 to 16 carbon atoms.

25. The process of claim 17, wherein the monomers of comb polymer B are derived from esters or ethers or mixtures of esters and ethers of ethylenically unsaturated alcohols having from 2 to 10 carbon atoms and carboxyfic acids or alcohols having alkyl radicals of from 8 to 16 carbon atoms.

26. The process of claim 17, wherein the monomers of comb polymer B further comprise comonomer B2) derived from the group consisting of esters, amides, imides, and mixtures thereof of ethylenically unsaturated dicarboxylic acids having from 4 to 8 carbon atoms and alcohols or amines having alkyl radicals of from 8 to 16 carbon atoms.

27. The process of claim 17, wherein the monomers of comb polymer B further comprise comonomer B2) derived from α-olefins having 10 to 20 carbon atoms.

28. The process of claim 17, wherein the monomers of comb polymer B contain substantially linear alkyl radicals.

29. The process of claim 17, wherein the average molecular mass of the comb polymer B is between 1000 and 100 000 g/mol.

30. The additive of claim 18, wherein R is from 11.5 to 13.5.

31. The additive of claim 18, wherein, apart from ethylene, constituent A comprises from 3.5 to 20 mol % of a first comonomer consisting of vinyl acetate and from 0.1 to 12 mol % of a further comonomer selected from the group consisting of vinyl neononanoate, vinyl 2-ethylhexanoate, vinyl neodecanoate, and mixtures thereof, and constituent A comprises a total comonomer content between 8 and 21 mol %.

32. The additive of claim 18, wherein, in addition to ethylene and from 8 to 18 mol % of vinyl esters, constituent A also comprises from 0.5 to 10 mol % of olefins selected from the group consisting of propene, butene, isobutylene, hexene, 4-methylpentene, octene, dilsobutylene, norbornene, and mixtures thereof.

33. The additive of claim 18, wherein constituent A has a melt viscosity of between 20 and 10 000 mPas.

34. The additive of claim 18, wherein constituent A has a degree of branching of between 1 and 9 $CH_3$/100 CH2 groups which do not stem from said alkyl radical.

35. The additive of claim 18, where the monomers of comb polymer B are derived from the group consisting of esters, amides, and mixtures thereof of ethylenically unsaturated carboxylic acids having from 3 to 8 carbon atoms and alcohols or amines having alkyl radicals of from 8 to 16 carbon atoms.

36. The additive of claim 18, wherein the monomers of comb polymer B are derived from esters or ethers or mixtures of esters and ethers of ethylenically unsaturated alcohols having from 2 to 10 carbon atoms and carboxylic acids or alcohols having alkyl radicals of from 8 to 16 carbon atoms.

37. The additive of claim 18, wherein the monomers of comb polymer B further comprise comonomer B2) derived from the group consisting of esters, amides, imides, and mixtures thereof of ethylenically unsaturated dicarboxylic acids having from 4 to 8 carbon atoms and alcohols or amines having alkyl radicals of from 8 to 16 carbon atoms.

38. The additive of claim 18, wherein the monomers of comb polymer B further comprise comonomer B2) derived from α-olefins having 10 to 20 carbon atoms.

39. The additive of claim 18, wherein the monomers of comb polymer B contain substantially linear alkyl radicals.

40. The additive of claim 18, wherein the average molecular mass of the comb polymer B is between 1000 and 100 000 g/mol.

* * * * *

UNITED STATES PATENT AND TRADEMARK OFFICE

CERTIFICATE OF CORRECTION

PATENT NO. : 7,476,264 B2
APPLICATION NO. : 10/972667
DATED : January 13, 2009
INVENTOR(S) : Matthias Krull It is certified that error appears in the above-identified patent and that said Letters Patent is hereby corrected as shown below:

Title page, item (73) Assignee should read:

(73) Assignee: Clariant Produkte (Deutschland) GmbH, Sulzbach (DE)

Signed and Sealed this

Thirty-first Day of March, 2009

John Doll

JOHN DOLL
*Acting Director of the United States Patent and Trademark Office*